US008608298B2

(12) United States Patent
Kanome et al.

(10) Patent No.: US 8,608,298 B2
(45) Date of Patent: Dec. 17, 2013

(54) PRINTING APPARATUS

(75) Inventors: Yuji Kanome, Yokohama (JP); Hiroyuki Tanaka, Kawasaki (JP); Yoshiaki Suzuki, Nagareyama (JP); Seiji Suzuki, Ebina (JP); Masahiro Sugimoto, Yokohama (JP); Takeaki Nakano, Inagi (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 13/087,286

(22) Filed: Apr. 14, 2011

(65) Prior Publication Data

US 2011/0254903 A1 Oct. 20, 2011

(30) Foreign Application Priority Data

Apr. 19, 2010 (WO) ..... PCT/JP2010/056954

(51) Int. Cl.
*B41J 2/175* (2006.01)

(52) U.S. Cl.
USPC ..... 347/85

(58) Field of Classification Search
USPC ..... 347/85, 89
See application file for complete search history.

(56) References Cited

U.S. PATENT DOCUMENTS

| | | | | |
|---|---|---|---|---|
| 4,680,696 | A * | 7/1987 | Ebinuma et al. | 347/85 |
| 4,737,801 | A * | 4/1988 | Ichihashi et al. | 347/85 |
| 5,561,448 | A * | 10/1996 | Kaneko et al. | 347/29 |
| 6,283,585 | B1 * | 9/2001 | Ikkatai et al. | 347/85 |
| 6,945,640 | B2 * | 9/2005 | Cheok | 347/85 |
| 7,591,545 | B2 * | 9/2009 | Iwasaki et al. | 347/84 |
| 2006/0209140 | A1 * | 9/2006 | Nagai | 347/85 |
| 2008/0079791 | A1 * | 4/2008 | Kang et al. | 347/89 |
| 2008/0239027 | A1 * | 10/2008 | Kinase et al. | 347/85 |

FOREIGN PATENT DOCUMENTS

| | | | |
|---|---|---|---|
| JP | 60-247564 | A | 12/1985 |
| JP | 11-188895 | A | 7/1999 |
| JP | 2007-044648 | A | 2/2007 |
| JP | 2007-144732 | A | 6/2007 |

* cited by examiner

*Primary Examiner* — Matthew Luu
*Assistant Examiner* — Michael Konczal
(74) *Attorney, Agent, or Firm* — Canon USA Inc. IP Division

(57) ABSTRACT

Provided is a printing apparatus in which bubbles in a print head are easily removed. The printing apparatus includes a first one-way valve disposed between the pump and the ink tank in the collection channel, the first one-way valve allowing movement of ink from the pump to the ink tank and blocking movement of ink from the ink tank to the pump; a circulation channel that connects the ink tank to the collection channel at a position between the pump and the first one-way valve, the circulation channel enabling circulation of ink from the ink tank, through the print head, and to the ink tank; and a second one-way valve disposed in the circulation channel, the second one-way valve allowing movement of ink from the ink tank to the pump and blocking movement of ink from the pump to the ink tank.

9 Claims, 11 Drawing Sheets

PRINTING APPARATUS

FIELD OF THE INVENTION

The present invention relates to a printing apparatus that prints an image on a sheet by ejecting ink.

DESCRIPTION OF THE RELATED ART

Japanese Patent Laid-Open No. 2007-144732 describes a liquid ejection device in which a liquid supply head (hereinafter simply referred to as a "head") ejects ink that is supplied from a sub-tank. In the liquid ejection device, ink is supplied from the sub-tank to a first ink supply chamber through a first joint opening in the head, and supplied to a main ink supply chamber through a first filter. Ink is supplied from the main ink supply chamber to nozzles N through a connection channel, which is formed in a top plate, and a common liquid chamber. Moreover, ink is supplied from the main ink supply chamber to a second ink supply chamber through a second filter, and then returned to the sub-tank through a second joint opening.

Japanese Patent Laid-Open No. 2007-144732 also describes a configuration including a bypass channel for removing bubbles from an upstream side of the first filter. The bypass channel connects the first ink supply chamber to the second ink supply chamber, and a third filter is disposed in the bypass channel.

SUMMARY OF INVENTION

However, the technology described in Patent Document 1 has a problem in that, although bubbles that are on the upstream side of the first filter can be removed by forming the bypass channel, bubbles may pass through, for example, the second filter while the ink is being supplied and collected, and the bubbles may remain in a channel along which ink is returned from the second ink supply chamber to the sub-tank.

Against such a background, an object of the present invention is to provide a printing apparatus in which bubbles in the head can be easily removed.

In order to achieve the object, according to an aspect of the present invention, a printing apparatus, which includes a print head that ejects ink, an ink tank that holds ink that is supplied to the print head, a supply channel for supplying ink from the ink tank to the print head, a collection channel for recovering ink from the print head to the ink tank, and a pump disposed in the collection channel, includes a first one-way valve disposed between the pump and the ink tank in the collection channel, the first one-way valve allowing movement of ink from the pump to the ink tank and blocking movement of ink from the ink tank to the pump; a circulation channel that connects the ink tank to the collection channel at a position between the pump and the first one-way valve, the circulation channel enabling circulation of ink from the ink tank, through the print head, and to the ink tank; and a second one-way valve disposed in the circulation channel, the second one-way valve allowing movement of ink from the ink tank to the pump and blocking movement of ink from the pump to the ink tank, wherein, when the pump is driven in a first direction, ink is supplied from the ink tank to the print head through the supply channel and ink is collected from the print head to the ink tank through the collection channel, and wherein, when the pump is driven in a second direction, the circulation is performed through the circulation channel, a part of the collection channel, and the supply channel.

Further features of the present invention will become apparent from the following description of exemplary embodiments with reference to the attached drawings.

DESCRIPTION OF EMBODIMENTS

First Embodiment

Hereinafter, an inkjet printing apparatus according to an embodiment will be described. The printing apparatus is a high-speed line printer that uses a long rolled continuous sheet (which has s length larger than the length of a unit image in the sheet conveying direction). The printing apparatus can perform simplex printing and duplex printing. Such a printing apparatus is suitable for, for example, a large-quantity printing in minilabs and the like. The present invention is applicable to printing apparatuses, such as a printer, a multifunction device, a copier, and a facsimile.

Figure 1:
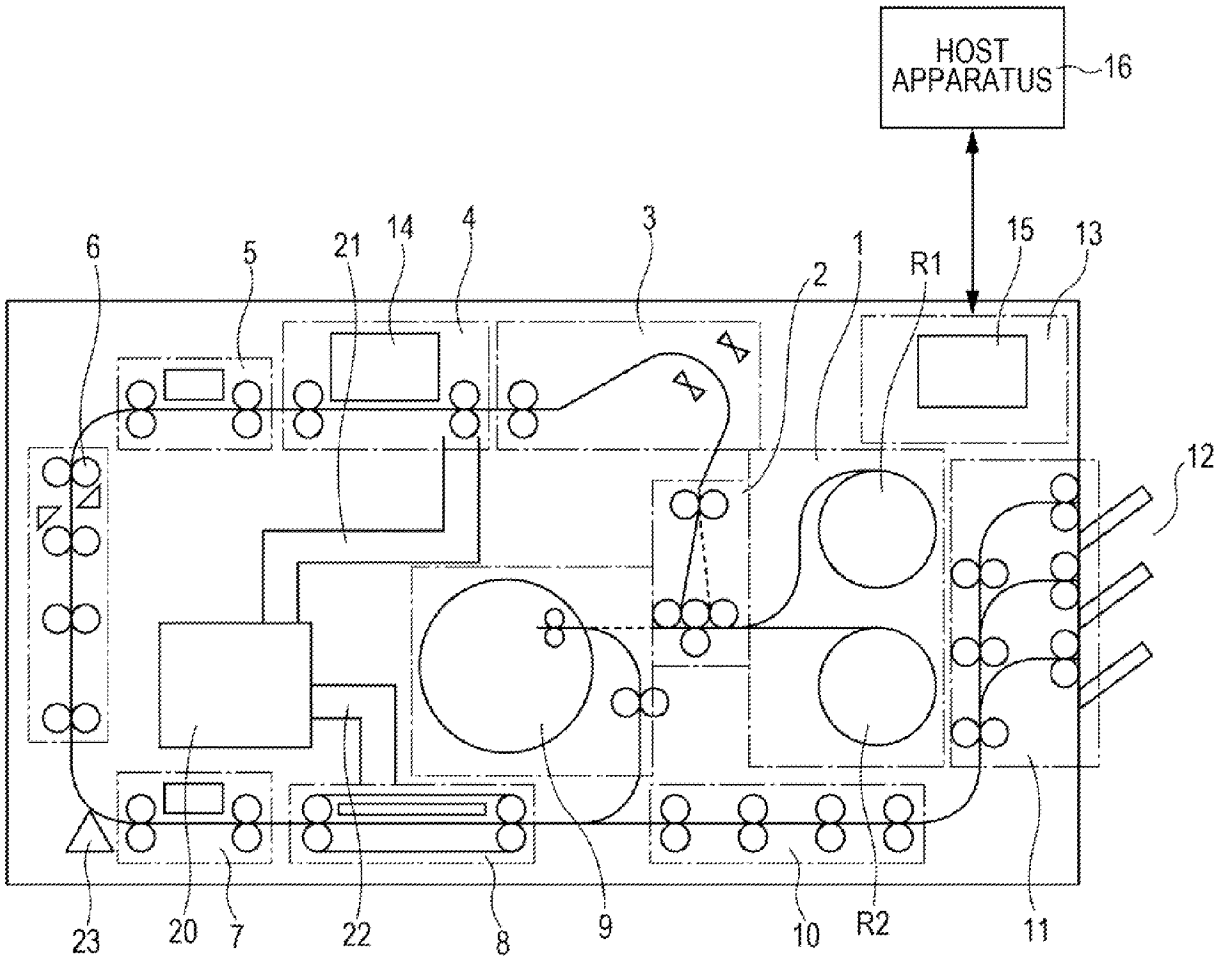
FIG. 1 is a schematic view illustrating the internal structure of a printing apparatus.

FIG. 1 is a schematic sectional view illustrating the internal structure of the printing apparatus. The printing apparatus according to the present embodiment can perform printing on both of a first surface and a second surface (on the back side of the first surface) of a rolled sheet. The printing apparatus includes a sheet feeding unit 1, a decurling unit 2, an inclination correction unit 3, a printing unit 4, an inspection unit 5, a cutting unit 6, an information recording unit 7, a drying unit 8, a reversing unit 9, an output-conveying unit 10, a sorting unit 11, an output unit 12, a humidifying unit 20, and a control unit 13. The sheet is conveyed along a sheet conveying path (illustrated by a solid line in FIG. 1) by a conveying mechanism, which includes pairs of rollers and belts, and the above-described units perform various processing on the sheet.

The sheet feeding unit 1 contains and feeds a rolled continuous sheet. The sheet feeding unit 1 can contain two rolls R1 and R2, and selectively unrolls and feeds a sheet from one of the rolls R1 and R2. The number of rolls is not limited to two, and the sheet feeding unit 1 may contain only one roll or more than two rolls.

The decurling unit 2 reduces curling (warping) of a sheet that has been fed from the sheet feeding unit 1. In the decurling unit 2, the sheet is conveyed while being nipped between one driving roller and two pinch rollers so as to apply a decurling force that warps the sheet in a direction opposite to the direction of curling, whereby the curling is reduced.

The inclination correction unit 3 corrects inclination of the sheet (with respect to the proper conveying direction) that has passed through the decurling unit 2. The inclination of the sheet is corrected by pressing a reference edge of the sheet against a guiding member.

The printing unit 4 forms an image on the sheet by performing print processing using a print head 14 (hereinafter referred to as a "head" as appropriate) from above while the sheet is being conveyed. That is, the printing unit 4 is a processing unit that performs predetermined processing on the sheet. The printing unit 4 includes a plurality of conveying rollers for conveying the sheet. The print head 14 includes a line print head in which nozzle arrays are formed over an area that covers the maximum width of a sheet to be used. In the print head 14, a plurality of print heads are arranged in the conveying direction. In the present embodiment, the print head 14 includes seven print heads for seven colors, i.e., cyan (C), magenta (M), yellow (Y), light cyan (LC), light magenta (LM), gray (G), and black (K). The number of colors and print heads is not limited to seven. As an inkjet method, a method using a heater element, a method using a piezoelectric element, a method using an electrostatic element, a method using an MEMS element, or the like can be used. Each color ink is supplied from the ink tank to the print head 14 through an ink tube.

The inspection unit 5 optically reads a test pattern or an image, which has been printed on the sheet by the printing unit 4, by using a scanner, inspects the state of nozzles in the print head, the state of sheet conveyance, and the position of the image, and thereby determines whether the image has been correctly printed. The scanner includes a CCD image sensor or a CMOS image sensor.

The cutting unit 6 includes a mechanical cutter for cutting the sheet into cut sheets having a predetermined length after the sheet has been printed. The cutting unit 6 further includes a plurality of conveying rollers for feeding the sheet to the next step.

The information recording unit 7 records print-related information (specific information), such as a serial number or the date of printing, in a margin of the cut sheet. The information is recorded by printing characters or codes by using an inkjet method, a thermal transfer method, or the like. A sensor 23 for detecting the front edge of the cut sheet is disposed upstream of the information recording unit 7 and downstream of the cutting unit 6. That is, the sensor 23 is configured to detect the edge of the sheet between the cutting unit 6 and the recording position of the information recording unit 7. The timing at which the information recording unit 7 performs information recording is controlled in accordance with the detection timing of the sensor 23.

The drying unit 8 heats the sheet that has been printed by the printing unit 4, and thereby quickly dries ink that has been applied onto the sheet. In the drying unit 8, hot air is blown onto the sheet, which is passing through the drying unit 8, at least from below so as to dry the surface onto which ink has been applied. The drying method is not limited to blowing of hot air. A method of irradiating the surface of the sheet with electromagnetic waves (ultraviolet radiation, infrared radiation, or the like) may be used.

The sheet conveying path extending from the sheet feeding unit 1 to the drying unit 8 will be referred to as a first path. The first path has a U-shaped part between the printing unit 4 and the drying unit 8. The cutting unit 6 is disposed in the middle of the U-shaped part.

The reversing unit 9, which is used for duplex printing, temporarily winds the continuous sheet after the first surface (front surface) of the sheet has been printed, and then reverses the sheet. The reversing unit 9 is disposed in a path (loop path) extending from the drying unit 8 to the printing unit 4 through the decurling unit 2. The path (which will be referred to as a second path) is used for conveying the sheet, which has passed through the drying unit 8, to the printing unit 4. The reversing unit 9 includes a rotary winding member (drum) for winding the sheet. When the first surface has been printed, the continuous sheet that is not cut is temporarily wound around the rotary winding member. After the sheet has been wound, the rotary winding member rotates in the reverse direction, and the sheet is fed to the decurling unit 2 and to the printing unit 4. Because the sheet has been reversed, the printing unit 4 can print the second surface (back surface) of the sheet. Specific operations of the duplex printing will be described below.

The output-conveying unit 10 conveys the sheet, which has been cut by the cutting unit 6 and dried by the drying unit 8, to the sorting unit 11. The output-conveying unit 10 is disposed in a path (referred to as a third path) that is different from the second path disposed in the reversing unit 9. In order to selectively guide the sheet, which has been conveyed along the first path, to one of the second path and the third path, a path switching mechanism is disposed at a position at which the path branches. The path switching mechanism includes a movable flapper.

The sorting unit 11 and the output unit 12 are disposed on a side of the sheet feeding unit 1 and at the farthest end of the third path. The sorting unit 11 sorts printed sheets as necessary. The sorted sheets are output to the output unit 12, which includes a plurality trays. Thus, the third path, which extends below the sheet feeding unit 1, outputs the sheet to a side of the sheet feeding unit 1 opposite to the side on which the printing unit 4 and the drying unit 8 are disposed.

The humidifying unit 20 generates humidified gas (air), and supplies the humidified gas to a space between the print head 14 of the printing unit 4 and the sheet. Thus, drying of ink in the nozzles in the print head 14 is suppressed. The humidifying unit 20 may be of an evaporative type, a water-spraying type, or a steam type. Examples of the evaporative type includes a rotary type, which is used in the present embodiment, a permeable membrane type, a membrane permeation type, a capillary type, etc. Examples of the water spray type includes an ultrasonic type, a centrifugal type, a high-pressure-spray type, a two-liquid spray type, etc. Examples of the steam type includes a steam duct type, an electrothermal type, an electrode type, etc. The humidifying unit 20 is connected to the printing unit 4 through a first duct 21 and to the drying unit 8 through a second duct 22. In the drying unit 8, hot humid gas is generated when the drying unit 8 dries the sheet. The gas is introduced to the humidifying unit 20 through the second duct 22, and is used as auxiliary energy for generating humidified gas in the humidifying unit 20. The humidified gas, which is generated by the humidifying unit 20, is introduced to the printing unit 4 through the first duct 21.

The control unit 13 controls the units of the entire printing apparatus. The control unit 13 includes a controller, an external interface, and an operation unit 15. The controller includes a CPU, a storage unit, and various controllers. A user performs input and output operations on the operation unit 15. The operation of the printing apparatus is controlled on the basis of a command that is sent from the controller or a host apparatus 16 such as a host computer, which is connected to the controller through an external interface.

Figure 2:
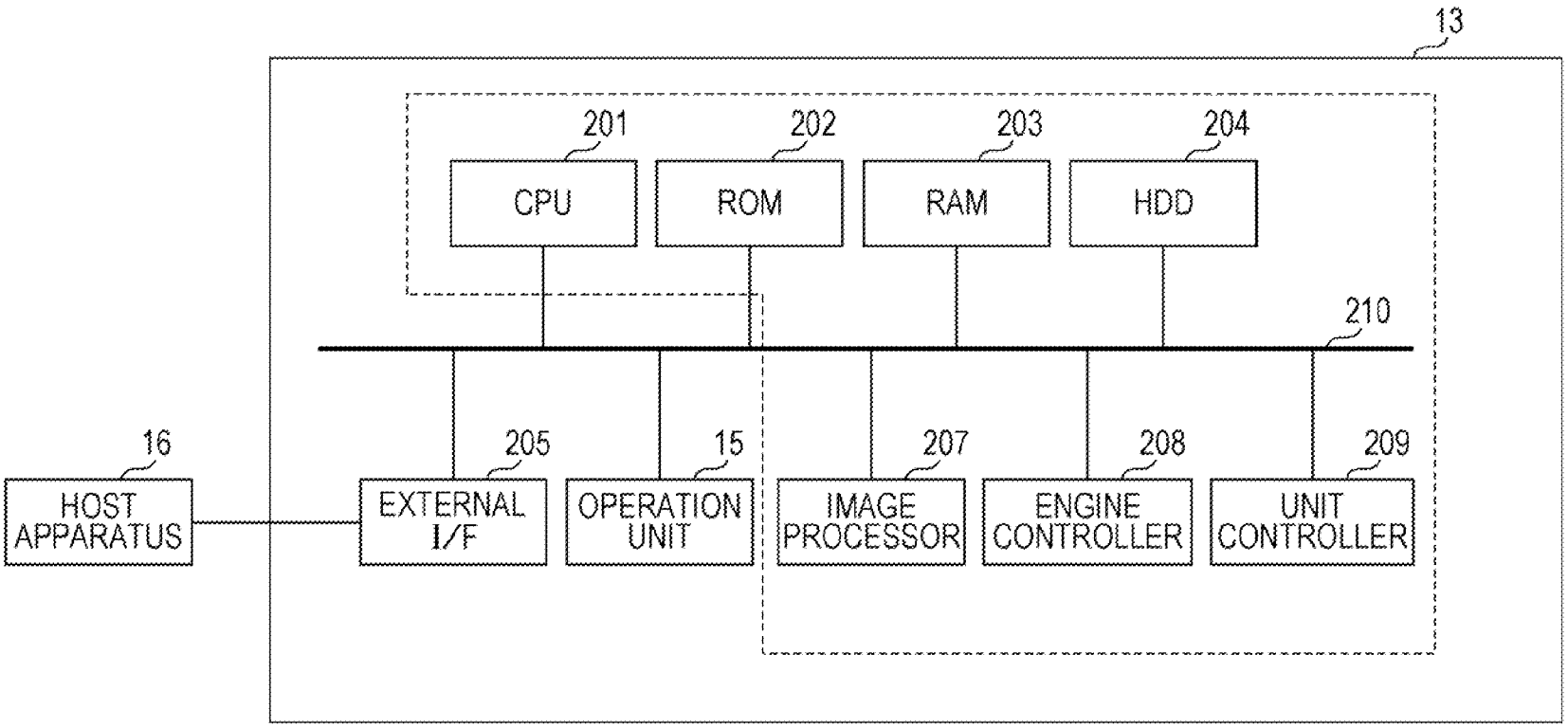
FIG. 2 is a block diagram of a control unit.

FIG. 2 is a block diagram of the control unit 13. The controller (surrounded by a broken line) of the control unit 13 includes a CPU 201, a ROM 202, a RAM 203, an HDD 204, an image processor 207, an engine controller 208, and a unit controller 209. The CPU (central processing unit) 201 performs overall control of the operations of the units included in the printing apparatus. The ROM 202 stores programs that are executed by the CPU 201 and fixed data that is necessary for the operations of the printing apparatus. The RAM 203 is used as a work area for the CPU 201, as a temporary storage area for various received data, and as a storage area for various setting data. The HDD (hard disk) 204 can store and read programs executed by the CPU 201, print data, and setting data necessary for operations of the printing apparatus. The operation unit 15 is an input/output interface for a user. The operation unit 15 has an input portion, such as a hardware keypad or a touch panel, and an output portion, such as a display for displaying information or a sound generator. For example, when a touch panel display is used, the operation status, print status, maintenance information (the amount of ink remaining, the amount of sheet remaining, the maintenance status, etc.) of the apparatus are displayed to the user. The user can input various information through the touch panel.

The units for which perform high-speed data processing is required each include a dedicated processor. The image processor 207 performs image processing of print data handled by the printing apparatus. The image processor 207 converts the color space (for example, YCbCr) of input image data into the standard RGB color space (for example, sRGB). As necessary, the image processor 207 performs various image processing operations, such as resolution conversion, image analysis, and image correction, on the image data. Print data obtained by such image processing is stored in the RAM 203 or the HDD 204. The engine controller 208 controls driving of the print head 14 of the printing unit 4 in accordance with the print data and on the basis of a control command received from the CPU 201 or the like. The unit controller 209 is a sub-controller that individually controls the sheet feeding unit 1, the decurling unit 2, the inclination correction unit 3, the inspection unit 5, the cutting unit 6, the information recording unit 7, the drying unit 8, the reversing unit 9, the output-conveying unit 10, the sorting unit 11, the output unit 12, and the humidifying unit 20. The operation of each unit is controlled by the unit controller 209 on the basis of a command from the CPU 201. An external interface 205, which is a local I/F or a network I/F, connects the controller to the host apparatus 16. The above-described units are connected to each other with a system bus 210.

The host apparatus 16 supplies image data to be printed by the printing apparatus. The host apparatus 16 may be a general-purpose or specific-purpose computer, or may be a dedicated imaging apparatus, such as an image capturing apparatus including an image reader, a digital camera, or a photo storage. When a computer is used as the host apparatus 16, an OS, application software for generating image data, and a printer driver for the printing apparatus are installed in a storage unit of the computer. It is not necessary that all processing described above be implemented by software. A part or all processing may be implemented by hardware.

Next, basic operations for printing will be described. Both the simplex printing mode and the duplex printing mode will be described, because operations in these modes are not the same.

Figure 3:
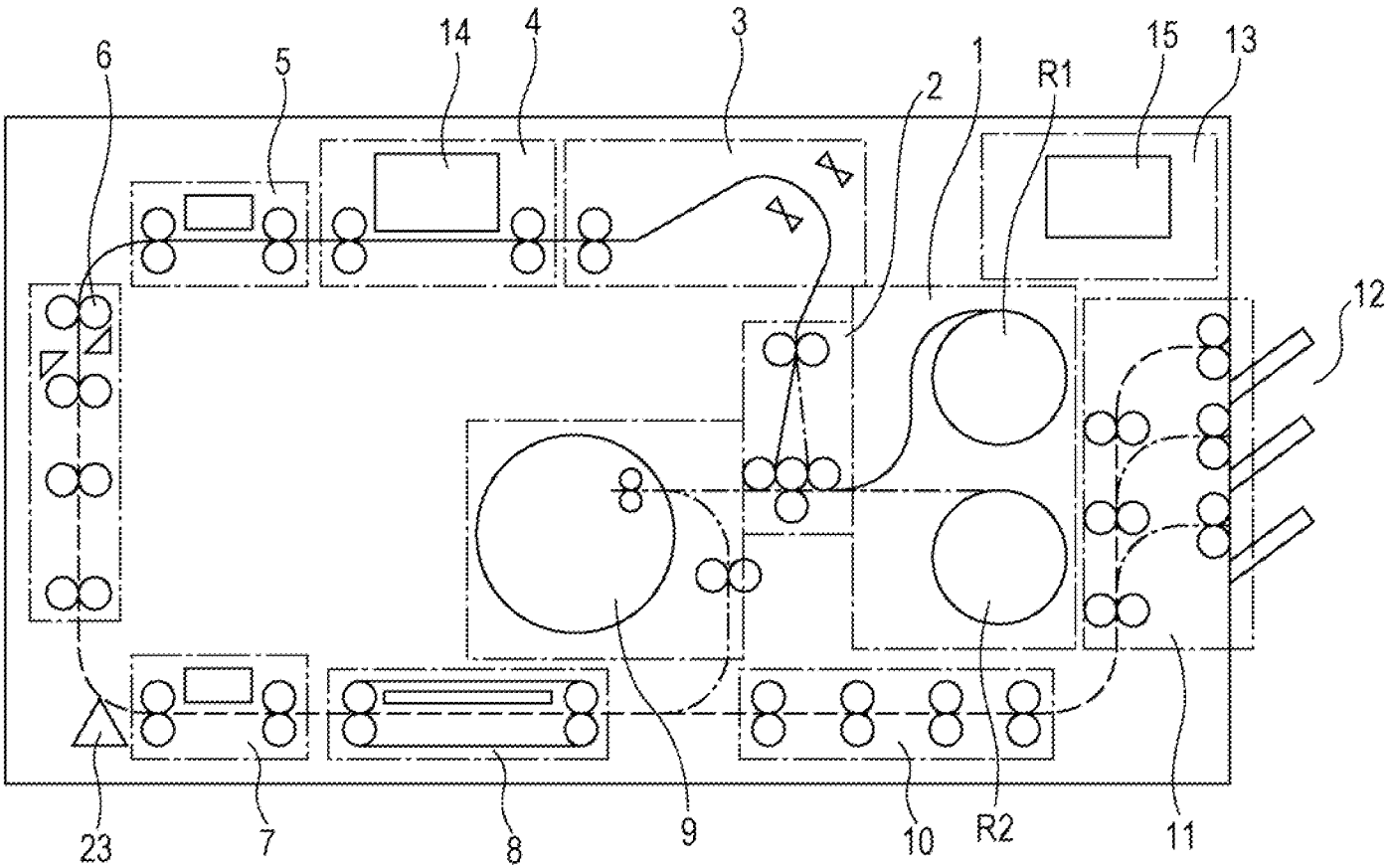
FIG. 3 illustrates the operation of the printing apparatus in a simplex printing mode.

FIG. 3 illustrates an operation in the simplex printing mode. A thick line represents a conveying path along which a sheet is fed from the sheet feeding unit 1, printed, and output to the output unit 12. The sheet is fed from the sheet feeding unit 1, is decurled by the decurling unit 2, and has the conveying direction corrected by the inclination correction unit 3. Then, the printing unit 4 prints the front surface (first surface) of the sheet. A plurality of images (unit images) each having a predetermined unit length in the sheet conveying direction are successively printed on the long continuous sheet. The printed sheet passes through the inspection unit 5, and the cutting unit 6 cuts the sheet into cut sheets each carrying a unit image. When necessary, the information recording unit 7 records print-related information on the back surface of the cut sheet. The cut sheets are individually conveyed to the drying unit 8, and dried by the drying unit 8. Subsequently, the cut sheets pass through the output-conveying unit 10, and are successively output to and stacked on the output unit 12 of the sorting unit 11. A part of the sheet that is remaining on the printing unit 4 side after a part of the sheet corresponding to the last unit image has been cut is conveyed back to the sheet feeding unit 1 and rolled into the roll R1 or R2. Thus, during simplex printing, the sheet passes along the first path and the third path and does not pass along the second pass.

Figure 4:
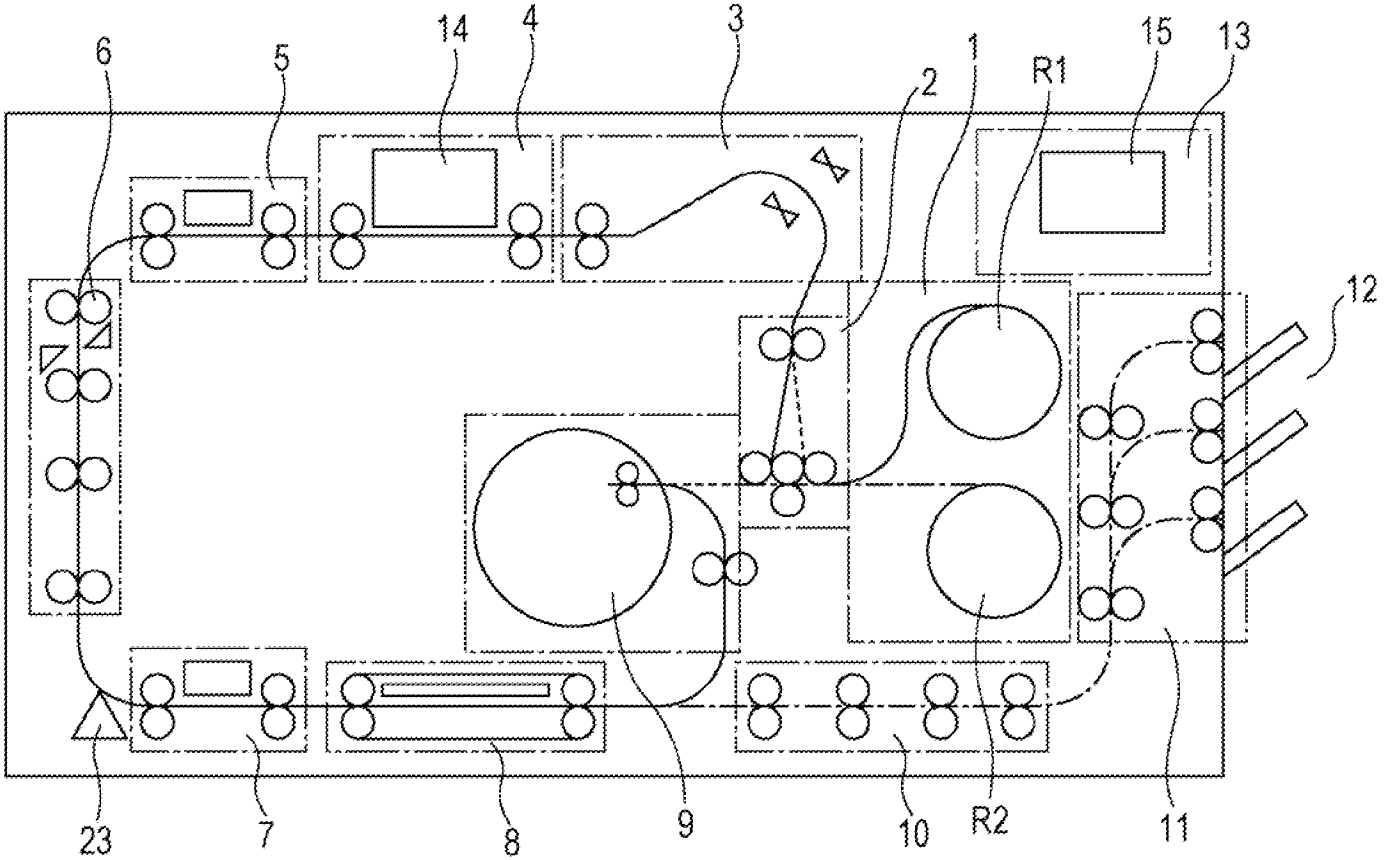
FIG. 4 illustrates the operation of the printing apparatus in a duplex printing mode.

FIG. 4 illustrates an operation in the duplex printing mode. During the duplex printing operation, a front surface (first surface) printing sequence and a back surface (second surface) printing sequence are successively performed. In the front surface printing sequence, the units from the sheet feeding unit 1 to the inspection unit 5 perform operations the same as those for the simplex printing described above. The cutting unit 6 does not cut the continuous sheet, and the continuous sheet is conveyed to the drying unit 8. The drying unit 8 dries ink on the front surface of the sheet. Then, the sheet is conveyed to a path (second path) that passes through the reversing unit 9 instead of a path (third path) that passes through the output-conveying unit 10. In the second path, the sheet is wound around a rotary winding member of the reversing unit 9, which rotates in the normal direction (counterclockwise in the FIG. 4). When printing on the front surface of the sheet is finished in the printing unit 4, the cutting unit 6 cuts the continuous sheet at the trailing end of the printed area. A part of the continuous sheet that is downstream of the cut position with respect to the conveying direction (a part including the printed area) passes through the drying unit 8 and is wound by the reversing unit 9 until the trailing end of the sheet (the cut position) is wound. The remaining part of the continuous sheet that is upstream (on the printing unit 4 side) of the cut position with respect to the conveying direction is wound back by the sheet feeding unit 1 so that the leading end of the sheet (the cut position) does not remain in the decurling unit 2, and the sheet is wound into the roll R1 or R2. Due to this winding-back operation, the sheet is prevented from colliding with a sheet that is fed again in the back surface print sequence described below.

After the above-described front surface printing sequence has been finished, the operation is switched to the back surface printing sequence. The rotary winding member of the reversing unit 9 rotates in a direction opposite to the winding direction (clockwise in the FIG. 4). The leading end of the sheet (i.e., the trailing end of the sheet when the sheet was wound) is fed into the decurling unit 2 along a path represented by a broken line in FIG. 4. The decurling unit 2 corrects curling of the sheet that is caused by the rotary winding member. That is, the decurling unit 2 is disposed in the first path between the sheet feeding unit 1 and the printing unit 4 and in the second path between the reversing unit 9 and the printing unit 4. In both paths, the decurling unit 2 serves as a decurler. The reversed sheet is conveyed through the inclination correction unit 3 to the printing unit 4, and printing is performed on the back surface of the sheet. The printed sheet passes through the inspection unit 5, and the cutting unit 6 cuts the continuous sheet into cut sheets each having a predetermined length. The information recording unit 7 does not record print information on the cut sheet because both sides of the cut sheet have been printed. The cut sheets are individually conveyed to the drying unit 8, pass through the output-conveying unit 10, and are successively output to and stacked on the output unit 12 of the sorting unit 11. Thus, during duplex printing, the sheet is processed while passing along the first path, the second path, the first path, and the third path.

Figure 5:
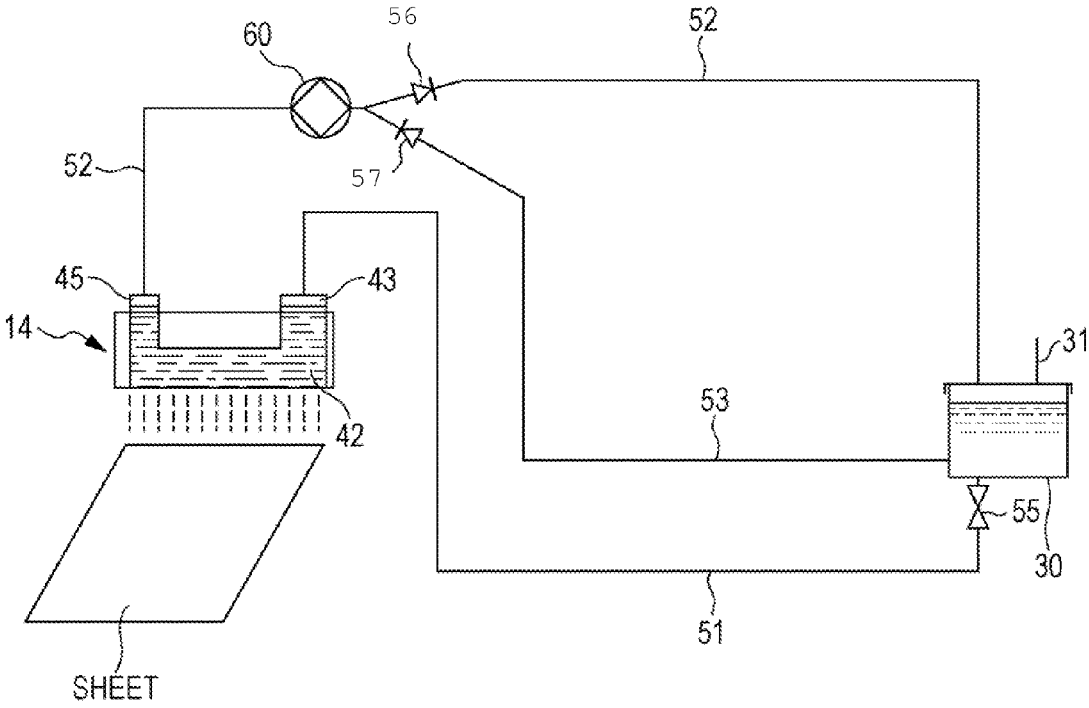
FIG. 5 illustrates an ink supply system that supplies ink from an ink tank to a print head according to a first embodiment.

FIG. 5 illustrates an ink supply system that supplies ink from an ink tank to a print head according to the first embodiment. In FIG. 5, an ink tank 30 holds ink that is supplied to the print head 14. The ink tank 30 has a breather pipe 31 that connects the inner space of the ink tank to the atmosphere. The print head 14 forms an image by ejecting ink onto a sheet that is conveyed below the print head 14. Ink is supplied from the ink tank 30 to the print head 14 through a supply channel 51. Ink is collected from the print head 14 to the ink tank 30 through a collection channel 52. Ink circulates in a circulation channel 53. An on-off valve 55 is disposed in the supply channel 51. A pump 60, which is disposed in the collection channel 52, can be driven in a normal direction and in a reverse direction. That is, the pump 60 can be driven in a first direction and in a second direction. A first one-way valve 56 is disposed in the collection channel 52 between the pump 60 and the ink tank 30. A second one-way valve 57 is disposed in the circulation channel 53 between the ink tank 30 and the pump 60. In FIG. 5, when performing recording on a sheet by ejecting ink from the print head 14, the pump 60 is driven in the normal direction and thereby the ink is supplied from the ink tank 30 to the print head 14 through the supply channel 51. Moreover, when the pump 60 is driven in the normal direction, the ink is collected from the print head 14 to the ink tank 30 through the collection channel 52.

Figure 6:
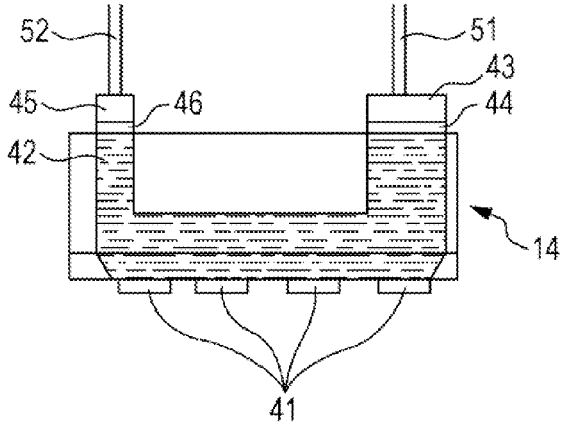
FIG. 6 illustrates the print head.

FIG. 6 illustrates the print head 14. In FIG. 6, ejection members 41 eject ink. A liquid chamber 42 holds ink in the print head 14. Ink is supplied from the supply channel 51 to the print head 14 through a supply port 43. A supply-side filter 44 is disposed in the supply port 43. When recovering ink from the print head 14 to the ink tank 30, the ink is supplied from the print head 14 to the collection channel 52 through a collection port 45. A collection-side filter 46 is disposed in the collection port 45.

Figure 7:
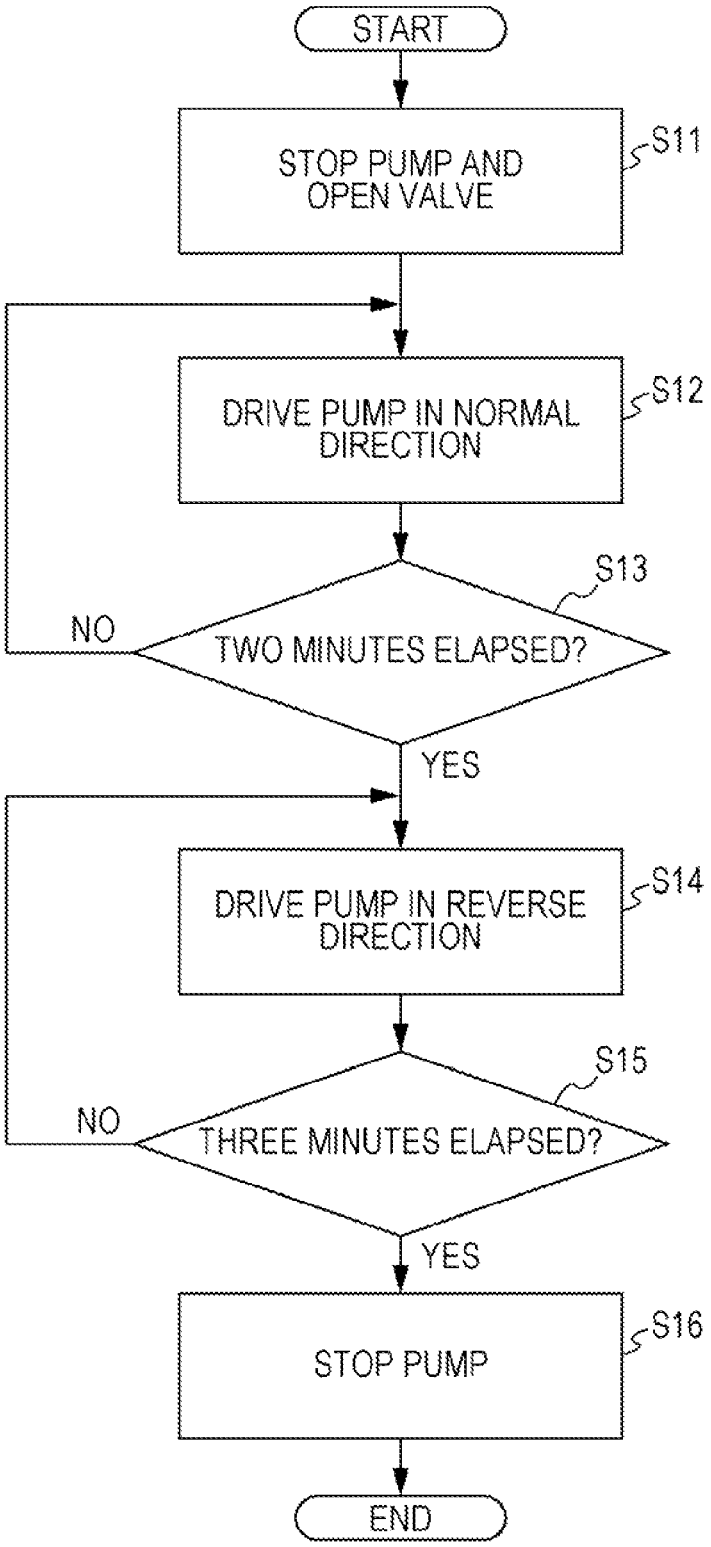
FIG. 7 illustrates a bubble-removing sequence for removing bubbles in the print head.

FIG. 7 is a flowchart of a bubble-removing sequence for removing bubbles from the print head 14. When the printing apparatus is used for a long time, bubbles accumulate in the liquid chamber 42 of the print head 14. Therefore, the bubble-removing sequence is performed at a predetermined timing.

In step S11 of FIG. 7, the control unit 13 stops the rotation of the pump 60, and opens the on-off valve 55.

In step S12, the control unit 13 drives the pump 60 in the normal direction. When the pump 60 is driven in the normal direction, ink is supplied from the ink tank 30 to the print head 14 through the supply channel 51. The ink is supplied into the liquid chamber 42 of the print head 14 through the supply port 43, moves in the liquid chamber 42, and is discharged to the collection channel 52 through the collection port 45. The ink, which has been discharged through the collection port 45, is collected to the ink tank 30 through the collection channel 52. By driving the pump 60 in the normal direction in step S12, bubbles that are trapped by the collection-side filter 46, which is disposed in the collection port 45, and bubbles in the liquid chamber 42 are discharged to the collection channel 52. As illustrated in FIG. 5, the collection channel 52 is disposed above the collection port 45 with respect to the direction of gravity. The bubbles, which have been discharged to the collection channel 52, are moved to the ink tank 30 due to the rotation of the pump 60 in the normal direction. The ink tank 30 has the breather pipe 31. The bubbles, which have been moved to the ink tank 30, are discharged to the outside of the ink tank 30 through the breather pipe 31.

In step S13, whether or not a predetermined time has elapsed is determined. In the present embodiment, whether or not two minutes have elapsed since the pump 60 was started to be driven in the normal direction is determined. If it is determined that two minutes have elapsed, in step S14, the control unit 13 drives the pump 60 in the reverse direction.

When the pump 60 is driven in the reverse direction, ink is supplied from the ink tank 30 to the print head 14 through the circulation channel 53. The circulation channel 53 is connected to the collection channel 52 on the ink tank 30 side of the pump 60. That is, the circulation channel 53 connects the ink tank 30 to the collection channel 52 at a position between the pump 60 and the first one-way valve 56. The circulation channel 53 is used for circulating ink from the ink tank 30, through the print head 14, and back to the ink tank 30. The second one-way valve 57 is disposed in the circulation channel 53. The second one-way valve 57 allows movement of ink from the ink tank 30 to the pump 60, and blocks movement of ink from the pump 60 to the ink tank 30. The first one-way valve 56 is disposed in the collection channel 52. The first one-way valve 56 allows movement of ink from the pump 60 to the ink tank 30, and blocks movement of ink from the ink tank 30 to the pump 60. Therefore, when the pump 60 is driven in the reverse direction, ink that is held in a part of the collection channel 52 between the pump 60 and the ink tank 30 does not move. Accordingly, even if bubbles remain in the part of the collection channel 52 between the pump 60 and the ink tank 30 while the pump 60 is driven in the normal direction, the bubbles do not return to the print head 14 when the pump 60 is driven in the reverse direction. By driving the pump 60 in the reverse direction, bubbles that have been trapped by the supply-side filter 44 disposed in the supply port 43 are discharged to the supply channel 51. Then, the bubbles, which have been discharged to the supply channel 51, are moved to the ink tank 30 due to the rotation of the pump 60 in the reverse direction. The bubbles, which have been moved to the ink tank 30, are discharged to the outside of the ink tank 30 through the breather pipe 31.

In step S15, whether or not a predetermined time has elapsed is determined. In the present embodiment, whether or not three minutes have elapsed since the pump 60 was started to be driven in the reverse direction is determined. In order to reliably move the bubbles to the ink tank 30 while the pump 60 is driven in the reverse direction, this time is longer than the time during which the pump 60 is driven in the normal direction. If it is determined that three minutes have elapsed, in step S16, the control unit 13 stops the rotation of the pump 60 and finishes the sequence.

Figure 8:
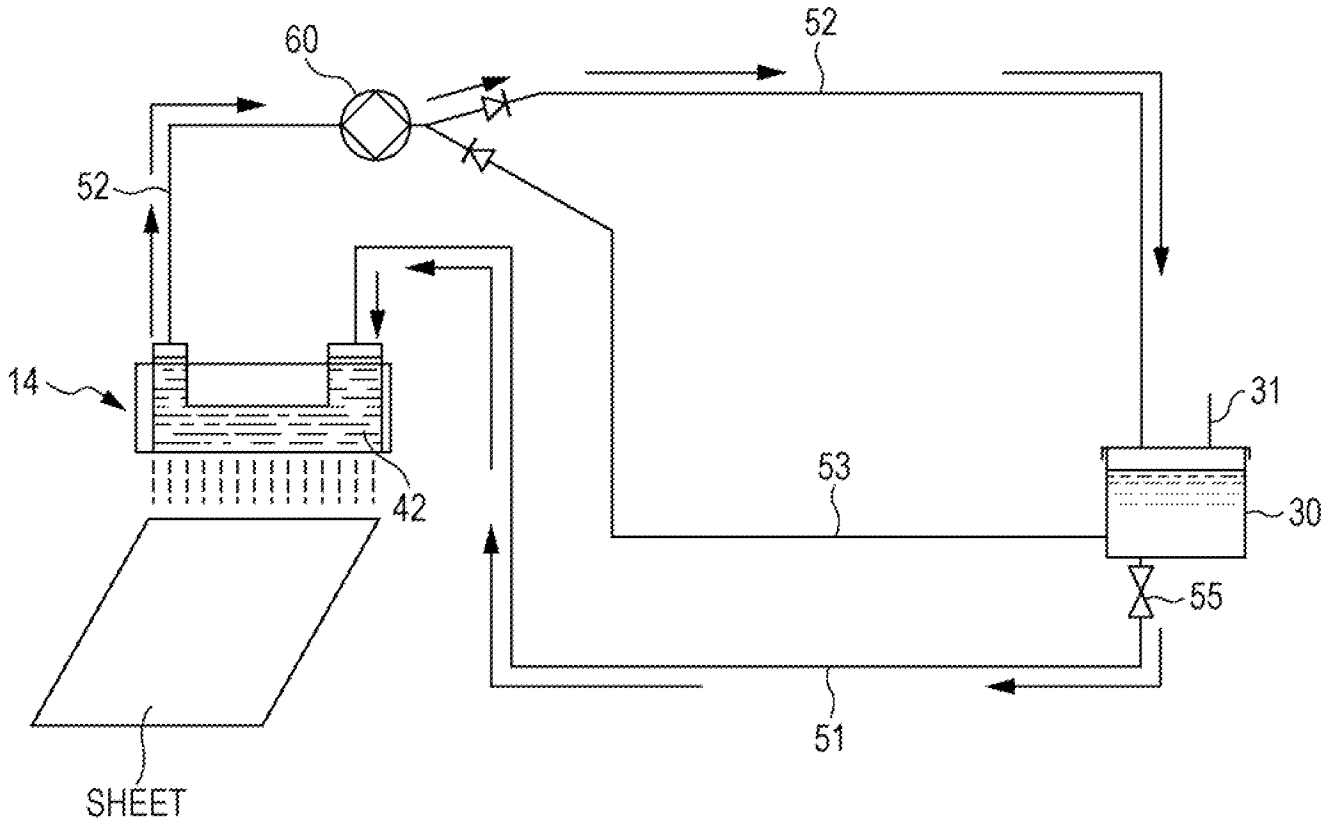
FIG. 8 illustrates the flow of ink when a pump is driven in a normal direction.

FIG. 8 illustrates the flow of ink when the pump 60 is driven in the normal direction. Ink is supplied from the ink tank 30 to the print head 14 through the supply channel 51, and the ink is collected from the print head 14 to the ink tank 30 through the collection channel 52.

Figure 9:
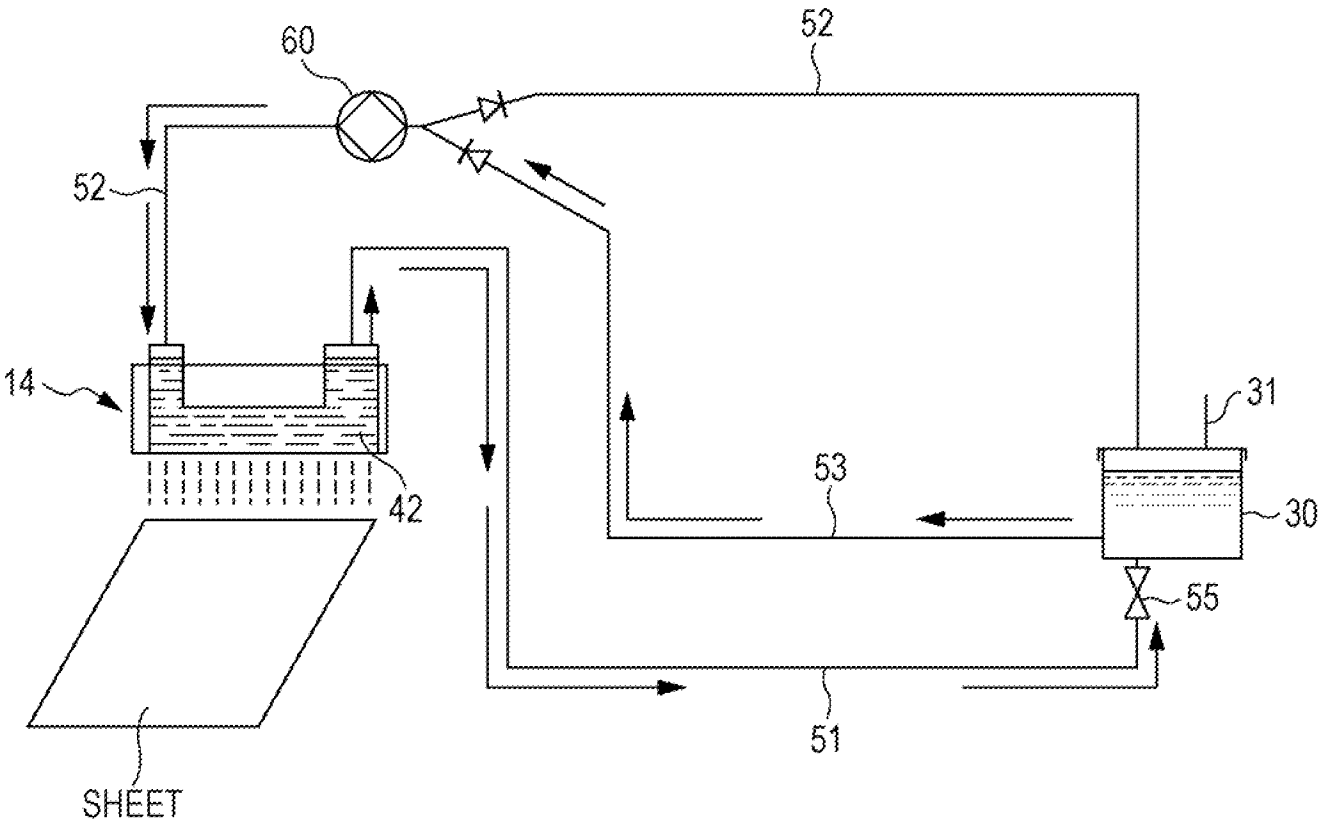
FIG. 9 illustrates the flow of ink when the pump is driven in a reverse direction.

FIG. 9 illustrates the flow of ink when the pump 60 is driven in the reverse direction. Ink is moved from the ink tank 30 to the pump 60 through the circulation channel 53, and the ink is moved from the pump 60 to the print head 14 through a part of the collection channel 52. Moreover, ink is moved from the print head 14 to the ink tank 30 through the supply channel 51.

According to the present embodiment, by driving the pump 60 in the normal direction and in the reverse direction, bubbles trapped by the collection-side filter 46 and bubbles trapped by the supply-side filter 44 can be removed. Moreover, because the circulation channel 53, through which ink flows only when the pump 60 is driven in the reverse direction, is connected to the collection channel 52 at a non-end position, bubbles that have been discharged due to the rotation of the pump 60 in the normal direction do not return to the print head 14.

Second Embodiment

The present embodiment differs from the first embodiment in that the second embodiment includes a second circulation channel 54 in addition to the supply channel 51. The second circulation channel 54 is used for moving ink from the print head 14 to the ink tank 30 when the pump 60 is driven in the reverse direction.

Figure 10:
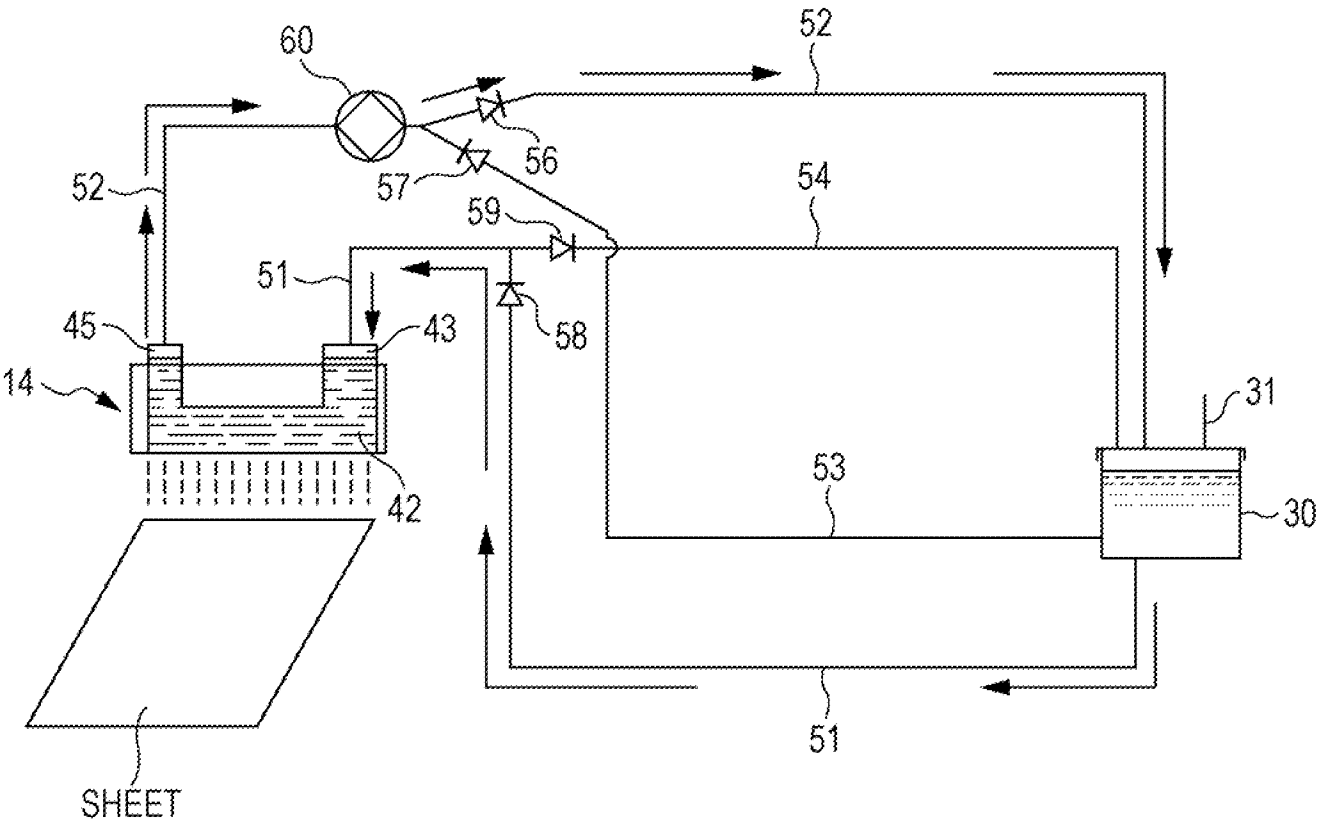
FIG. 10 illustrates the flow of ink when the pump is driven in the normal direction in a second embodiment.

FIG. 10 illustrates the flow of ink when the pump 60 is driven in the normal direction. When the pump 60 is driven in the normal direction, ink is supplied from the ink tank 30 to the print head 14 through the supply channel 51, and the ink is supplied from the print head 14 to the ink tank 30 through the collection channel 52. When the pump 60 is driven in the normal direction, bubbles trapped by the collection-side filter 46 are discharged to the collection channel 52.

A third one-way valve 58 is disposed in the supply channel 51. The third one-way valve 58 allows movement of ink from the ink tank 30 to the print head 14 through the supply channel 51, and blocks movement of ink from the print head 14 to the ink tank 30 through the supply channel 51. Although the first embodiment includes the on-off valve 55, the present embodiment does not include the on-off valve 55 because the present embodiment includes the third one-way valve 58.

Figure 11:
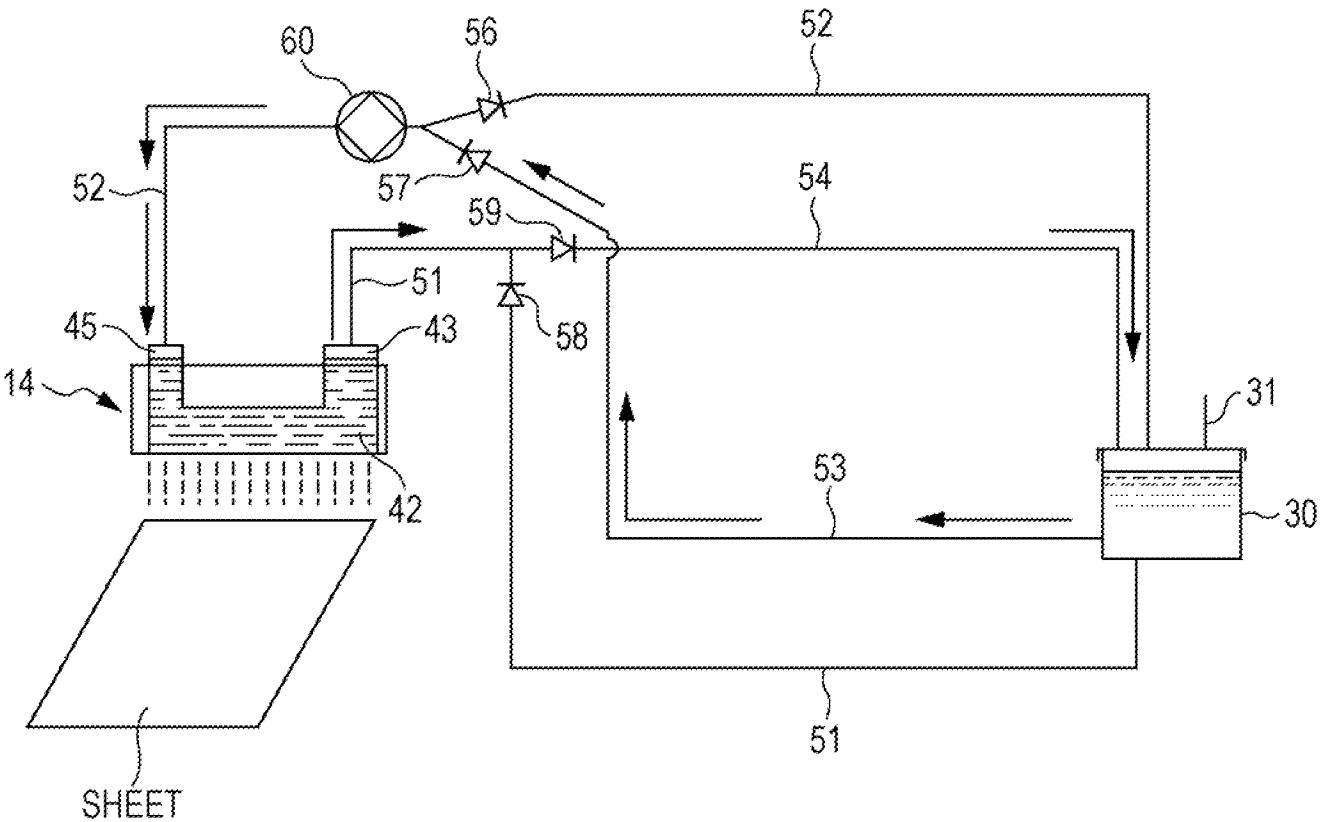
FIG. 11 illustrates the flow of ink when the pump is driven in the reverse direction.

FIG. 11 illustrates the flow of ink when the pump 60 is driven in the reverse direction. In FIG. 11, the second circulation channel 54 is connected to the supply channel 51 on the print head 14 side of the third one-way valve 58. A fourth one-way valve 59 is disposed in the second circulation channel 54. The fourth one-way valve 59 allows movement of ink from the print head 14 to the ink tank 30, and blocks movement of ink from the ink tank 30 to the print head 14.

When the pump 60 is driven in the reverse direction, ink is moved from the ink tank 30 to the print head 14 through the circulation channel 53, and ink is moved from the print head 14 to the ink tank 30 through the second circulation channel 54. By driving the pump 60 in the reverse direction, bubbles trapped by the supply-side filter 44 are discharged to the second circulation channel.

In the present embodiment, the second circulation channel 54 is provided in addition to the supply channel 51, and ink is not moved to the supply channel 51 when the pump 60 is driven in the reverse direction. According to the present embodiment, bubbles that are trapped by the supply-side filter 44 when the pump 60 is driven in the reverse direction do not remain in the supply channel 51. Therefore, when the pump 60 is driven in the normal direction after the pump 60 is driven in the reverse direction, the bubbles do not return to the print head 14.

Third Embodiment

The present embodiment differs from the first embodiment in that a buffer tank 70 is disposed between the pump 60 in the collection channel 52 and the ink tank 30.

Figure 12:
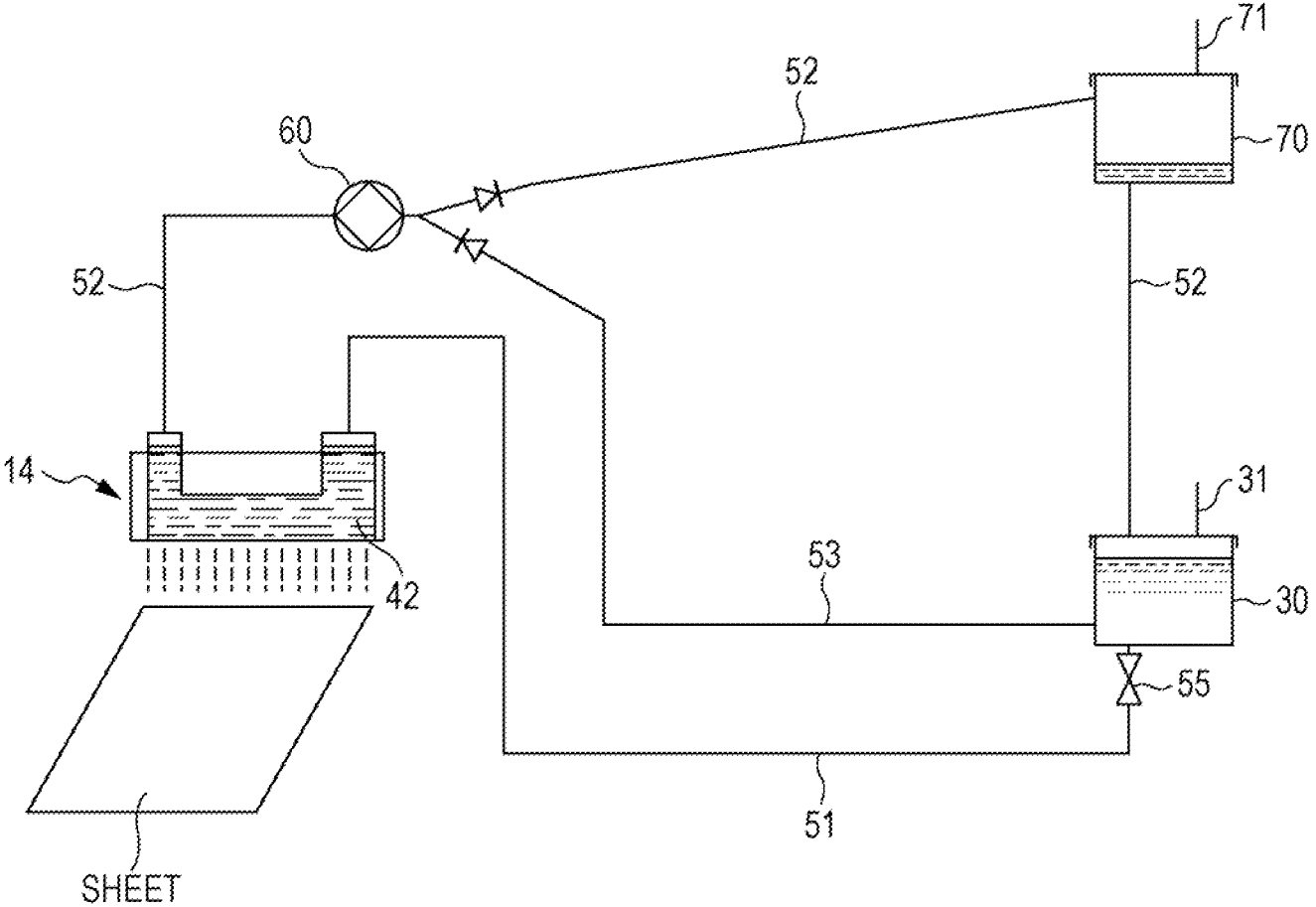
FIG. 12 illustrates an ink supply system that supplies ink from the ink tank to the print head according to a third embodiment.

FIG. 12 illustrates an ink supply system that supplies ink from the ink tank to the print head according to the third embodiment. In FIG. 12, the buffer tank 70 is disposed between the pump 60 in the collection channel 52 and the ink tank 30. The buffer tank 70 is disposed at the highest position of the collection channel 52 with respect to the direction of gravity. The buffer tank 70 has a breather pipe 71 that connects the inner space of the buffer tank to the atmosphere. According to the present embodiment, because the buffer tank 70 is disposed at the highest position of the collection channel 52 with respect to the direction of gravity, bubbles can be reliably collected in the buffer tank 70 when the pump 60 is driven in the normal direction.

The present invention provides a printing apparatus in which bubbles in the print head are easily removed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2010/056954, filed Apr. 19, 2010, which is hereby incorporated by reference herein in its entirety.

What is claimed is:

1. A printing apparatus comprising:

a print head that ejects ink;

an ink tank that holds ink that is supplied to the print head;

a supply channel for supplying ink from the ink tank to the print head;

a first filter for trapping bubbles disposed in a supply port through which ink is supplied from the supply channel to the print head;

a collection channel for collecting ink from the print head to the ink tank;

a second filter for trapping bubbles disposed in a collection port through which ink is supplied from the print head to the collection channel;

a pump disposed in the collection channel;

a first one-way valve disposed between the pump and the ink tank in the collection channel, the first one-way valve allowing movement of ink from the pump to the ink tank and blocking movement of ink from the ink tank to the pump;

a circulation channel that connects the ink tank to a position between the pump and the first one-way valve of the collection channel;

a second one-way valve disposed in the circulation channel, the second one-way valve allowing movement of ink from the ink tank to the pump and blocking movement of ink from the pump to the ink tank; and control means for controlling the pump, wherein the control means causes the pump to rotate in a first direction so that ink is supplied from the ink tank to the print head through the supply channel and ink is collected from the print head to the ink tank through the collection channel, and the control means causes the pump to rotate in a second direction so that ink is supplied from the ink tank to the print head through the circulation channel and ink is collected from the print head to the ink tank through the supply channel.

2. The printing apparatus according to claim 1, wherein the control means rotates the pump in the first direction and then rotates the pump in the second direction.

3. The printing apparatus according to claim 2, wherein a time during which the pump is rotated in the second direction is longer than a time during which the pump is rotated in the first direction.

4. The printing apparatus according to claim 1, wherein an on-off valve for opening and closing the supply channel is disposed in the supply channel.

5. The printing apparatus according to claim 1, further comprising:

a second circulation channel for moving ink from the print head to the ink tank when the pump is driven in the second direction.

6. The printing apparatus according to claim 5, further comprising:

a third one-way valve disposed in the supply channel, the third one-way valve allowing movement of ink from the ink tank to the print head and blocking movement of ink from the print head to the ink tank, wherein the second circulation channel is connected to the supply channel at a position between the third one-way valve and the print head.

7. The printing apparatus according to claim 6, further comprising:

a fourth one-way valve disposed in the second circulation channel, the fourth one-way valve allowing movement of ink from the print head to the ink tank and blocking movement of ink from the ink tank to the print head.

8. The printing apparatus according to claim 7, wherein, when the pump is driven in the second direction, ink moves from the ink tank to the print head through the circulation channel and a part of the collection channel, and ink moves from the print head to the ink tank through a part of the supply channel and the second circulation channel.

9. The printing apparatus according to claim 1, wherein a buffer tank is disposed between the pump in the collection channel and the ink tank.

* * * * *